US005947297A

United States Patent [19]

Aoki et al.

[11] Patent Number: 5,947,297

[45] Date of Patent: Sep. 7, 1999

[54] PACKAGING CASE

[75] Inventors: Yoshiharu Aoki; Masahiko Ito; Hisashi Nakano, all of Tokyo, Japan

[73] Assignees: Sigma P.I. Co., Ltd., Osaka; Sony Corporation, Tokyo, both of Japan

[21] Appl. No.: 09/136,732

[22] Filed: Aug. 19, 1998

[30] Foreign Application Priority Data

Aug. 19, 1997 [JP] Japan ..... 9-222172
Jul. 17, 1998 [JP] Japan ..... 10-203185

[51] Int. Cl.[6] ..... B65D 85/88

[52] U.S. Cl. ..... 206/705; 206/446; 206/461; 206/776

[58] Field of Search ..... 206/703–705, 206/775, 776, 777, 779, 781, 782, 783, 461, 471, 446, 443, 806, 462, 333

[56] References Cited

U.S. PATENT DOCUMENTS

| | | | |
|---|---|---|---|
| 3,990,578 | 11/1976 | Roeser . | |
| 5,018,622 | 5/1991 | Hartley . | |
| 5,379,894 | 1/1995 | Haas et al. | 206/705 |
| 5,392,919 | 2/1995 | Passamoni | 206/705 |
| 5,544,755 | 8/1996 | Paumen et al. | 206/705 |

FOREIGN PATENT DOCUMENTS

| | | | |
|---|---|---|---|
| 531654 | 3/1993 | European Pat. Off. | 206/333 |
| 30 34 363 | 3/1982 | Germany . | |
| 91 01 386 | 6/1992 | Germany . | |

*Primary Examiner*—Paul T. Sewell
*Assistant Examiner*—Luan K. Bui
*Attorney, Agent, or Firm*—Foley & Lardner

[57] ABSTRACT

The packaging case comprises, when assembled, a back part (aback hanging board), a bottom part (a bottom cover), a front part (a front cover, a front hanging board), the boards and covers being formed continuously in this order and bordered by fold lines, and a side part (a side cover, a glue margin) continuously extending from each side edge of the front cover except the neighborhood of the front hanging board and bordered by fold lines. A window is formed in the front cover, and a hook hole is respectively punched in the front and the back hanging boards to make a single matching hook hole. In one side edge of the back hanging board, a U-shaped perforated tear portion is provided for tearing off a part of the side edge glued to a corresponding glue margin. By gluing the front hanging board and the glue margins to the back hanging board, a plurality of cylindrical articles are enclosed by the front cover, bottom cover, back hanging board and side covers, with both ends of each article facing the side covers, and the cylindrical surface thereof being partially exposed through the window.

10 Claims, 10 Drawing Sheets

PACKAGING CASE

BACKGROUND OF THE INVENTION

The present invention relates to packaging cases, particularly packaging cases for batteries and other cylindrical articles.

As packaging cases for batteries and other cylindrical articles, Japanese Utility Model Application Laid-open No. 35064/1991 (JP-U-3-35064) discloses a blister pack-type package (FIG. 10) and a shrink pack-type package (FIG. 11). A blister pack-type package comprises a vinyl-treated mount 120 with a hook hole 121 punched in the upper part thereof, and a box-shaped synthetic film 124 which is large enough to cover a plurality of batteries 123 entirely. With the batteries 123 rested side by side on the lower half of the mount 120, the periphery 125 of the film 124 is thermally press-bonded to the mount 120. In a shrink pack-type package, a plurality of batteries 123 are placed lengthwise on a mount 120. A shrink film 127 is arranged to wrap the batteries 123 as well as the mount 120, with covering a pair of notches 126. Then, shrink pack-type packaging is completed by shrinking the shrink film 127 through heating.

SUMMARY OF THE INVENTION

The problem common to these conventional methods is to separate a synthetic resin film sealed on a mount. The troublesome process for the separation of the synthetic film and the mount often results in indiscreet disposal of the packages made of different types of materials. However, unseparate trash disposal and waste treatment should not be tolerated in terms of worldwide concern about environmental protection and recycling of materials. Therefore, it is an object of the present invention to provide a packaging case which firmly holds a packaged article (packaged product), still permits clear visual access to the packaged product in display, and further contributes to separate disposal of trashes or wastes.

The present invention is intended to solve the above-mentioned problems. According to the embodiment of claim 1, the packaging case comprises, when assembled: a back part comprised of a back hanging board; a bottom part comprised of a bottom cover; a front part comprised of a front cover and a front hanging board to be glued to the back hanging board; the boards and covers being formed continuously in this order and bordered by fold lines; and a side part comprised of a side cover and a glue margin continuously extending from each side edge of the front cover and bordered by fold lines. This packaging case has a window provided in the front cover, as well as a hook hole respectively punched in the front hanging board and the back hanging board such that a pair of hook holes match each other when these hanging boards are glued together. By gluing the front hanging board and the glue margins to the back hanging board, respectively, a plurality of cylindrical articles are enclosed in a space surrounded by the front cover, the bottom cover, the back hanging board and the side covers, wherein the end surfaces of each cylindrical article face the side covers, and the cylindrical surface thereof is partially exposed through the window.

In a preferable arrangement, the side covers and glue margins are formed on both side edges of the front cover except the neighbourhood of the front hanging board. Besides, a U-shaped perforated tear portion is provided in one of the side edges of the back hanging board, for the purpose of tearing off a part of the side edge to which a corresponding glue margin is glued. Further, an H-shaped cut is created in the front cover to provide two flaps, so that the window is formed by inwardly folding a flap on the bottom cover side and gluing the other flap to the back hanging board.

According to the embodiment of claim 5, the packaging case comprises, when assembled: a back part comprised of a back hanging board; a bottom part comprised of a bottom cover; a front part comprised of a front cover and a front hanging board to be glued to the back hanging board; the boards and covers being formed continuously in this order and bordered by fold lines; and a side part comprised of a side cover and a glue margin continuously extending from each side edge of the front cover and bordered by fold lines. This packaging case has two windows provided at a predetermined gap in the surface including the front cover and the bottom cover, as well as a hook hole respectively punched in the front hanging board and the back hanging board such that a pair of hook holes match each other when these hanging boards are glued together. By gluing the front hanging board and the glue margins to the back hanging board, respectively, a plurality of cylindrical articles are enclosed in a space surrounded by the front cover, the bottom cover, the back hanging board and the side covers, wherein the end surfaces of each cylindrical article face the side covers, and the cylindrical surface thereof is partially exposed through the windows, with the space in the packaging case being partitioned so that each partitioned compartment can accommodate plural articles.

In a preferable arrangement, the side covers and glue margins are formed on both side edges of the front cover except the neighbourhood of the front hanging board. Besides, two U-shaped perforated tear portions are provided at the positions corresponding to the windows in one of the side edges of the back hanging board, for the purpose of tearing off a part of the side edge to which a corresponding glue margin is glued. For separate opening of the two windows (two windowed compartments), a perforation line runs through the side cover and the glue margin on the side of the tear portions. Further, two H-shaped cuts are oppositely created in the surface including the front cover and the bottom cover to provide four flaps, so that the two windows are formed by gluing the flaps on both ends to the back hanging board and inwardly folding the middle flaps in between. The folded middle flaps also serve to partition the space in the packaging case into two compartments, each of which can contain a plurality of cylindrical articles.

According to the embodiment of claim 9, the packaging case comprises, when assembled: a back part comprised of a back hanging board, a top cover and a back cover; a front/bottom part comprised of a front/bottom cover and a front hanging board to be glued to the back hanging board; the boards and covers being formed continuously in this order and bordered by fold lines; and a side part comprised of a side cover and a glue margin continuously extending from each side edge of the front/bottom cover. This packaging case has two windows provided in the front/bottom cover at a predetermined gap, as well as a hook hole respectively punched in the front hanging board and the back hanging board such that a pair of hook holes match each other when these hanging boards are glued together. By gluing the front hanging board to the back hanging board and the glue margins to the back cover, a plurality of cylindrical articles are enclosed in a space surrounded by the front/bottom cover, the back cover, the top cover and the side covers, wherein the end surfaces of each cylindrical article face the side covers, and the cylindrical surface thereof is partially exposed through the windows.

In a preferable arrangement, the side covers and glue margins are formed on both side edges of the front/bottom cover except the neighbourhood of the front hanging board and the back cover. Besides, two U-shaped perforated tear portions are provided at the positions corresponding to the windows in one of the side edges of the back cover, for the purpose of tearing off a part of the side edge to which a corresponding glue margin is glued. For separate opening of the two windows (two windowed compartments), a perforation line runs through the side cover and the glue margin on the side of the tear portions. Further, two H-shaped cuts are oppositely created in the front/bottom cover to provide four flaps, so that the two windows are formed by inwardly folding the flaps along fold lines. Of these flaps, two middle flaps serve to partition the space in the packaging case into two compartments, each of which can contain a cylindrical article. In addition, the front hanging board and the back hanging board are glued along the longitudinal axis of the cylindrical articles.

Furthermore, there may be provided reinforcement flaps extending from the top and bottom ends of the side covers, with bordered by fold lines. The reinforcement flaps are inwardly folded along the fold lines, substantially at a right angle.

Any packaging case of the above embodiments has a window or windows, through which packaged cylindrical articles can be visually recognised. Since all constituent boards and covers are formed continuously with bordered by fold lines, the packaging case can be made of a one-piece mount (e.g. board, cardboard). Consequently, such a packaging case is disposable in a simple and judicious way, and, further, the mount can be utilised as recycled paper or the like. In another aspect, the packaging case made of continuous sections encloses and securely holds the cylindrical articles, so that the contents therein do not bounce out. When the packaging case falls off, it can protect the cylindrical articles from the impact of the fall, owing to the dual structure in which the periphery of the back hanging board is glued to the front hanging board and the glue margins, and also owing to the cusion effect of the flap which also forms the window.

DETAILED DESCRIPTION OF THE PREFERRED EMBODIMENTS

Preferred embodiments of the present invention are hereinafter described with reference to the attached drawings.

Figure 1:
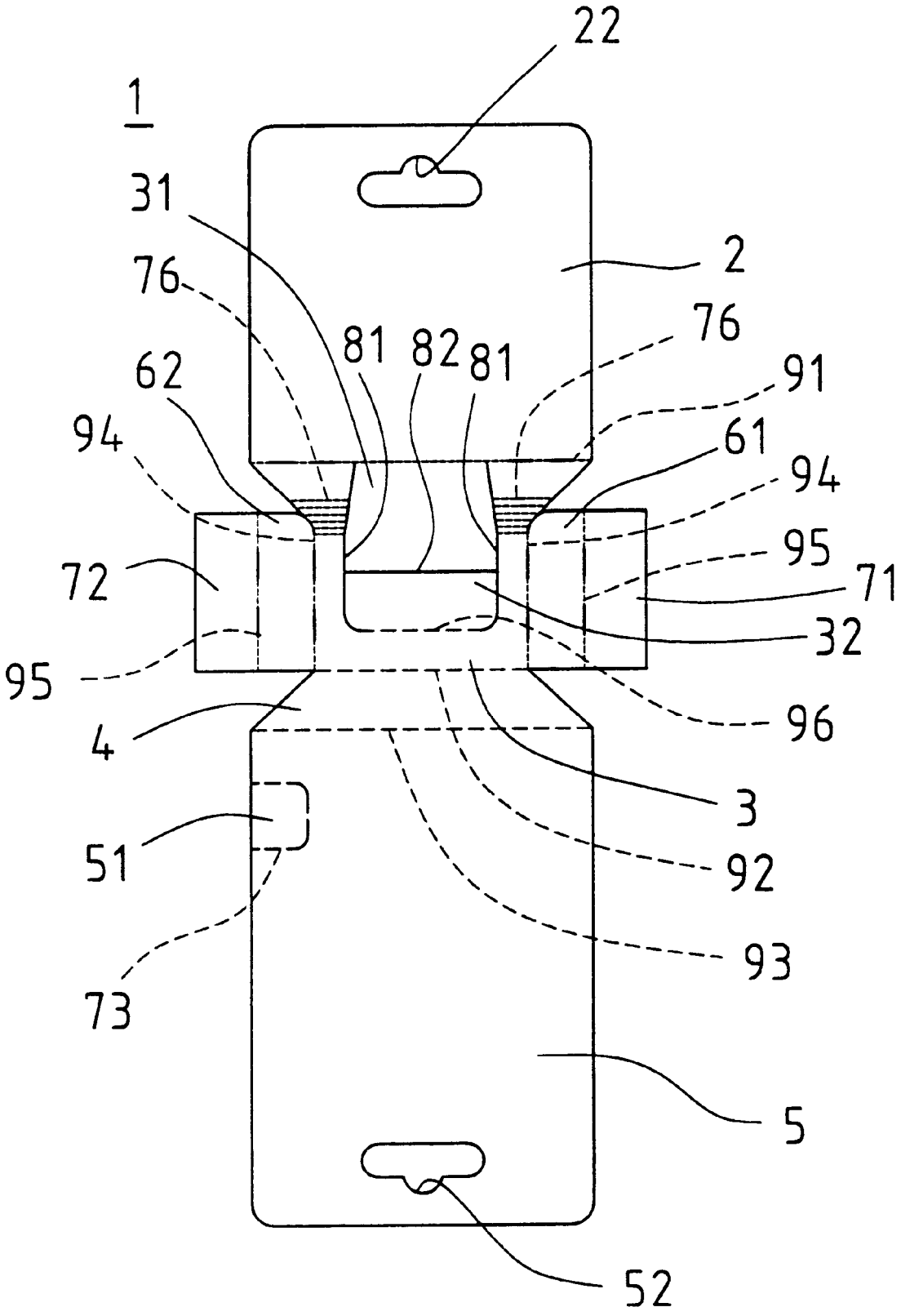
FIG. 1 is a development of a packaging case according to the first embodiment of the present invention.
Figure 2:
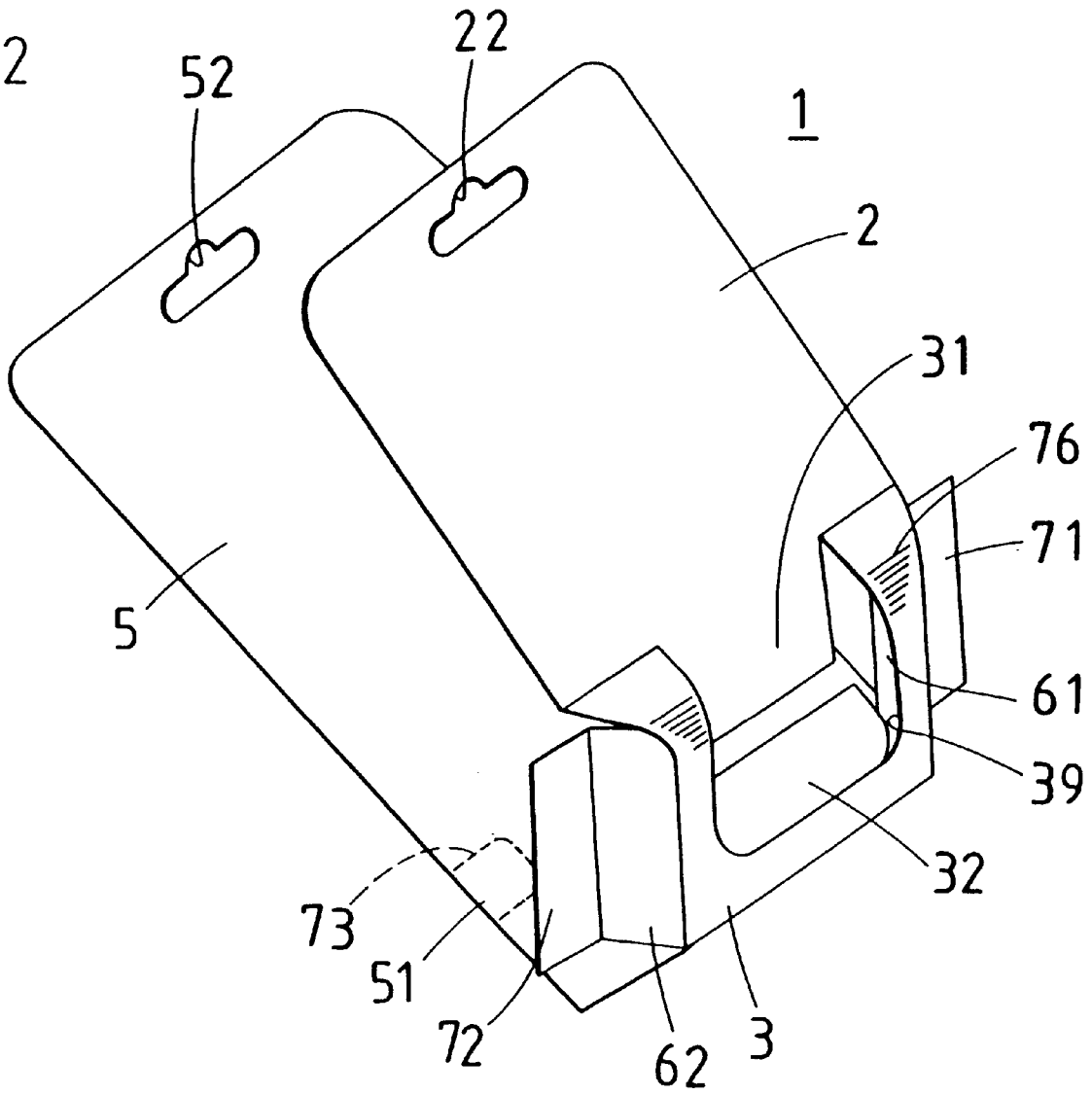
FIG. 2 is a perspective view of a packaging case during the assembly process according to the first embodiment of the present invention.
Figure 3:
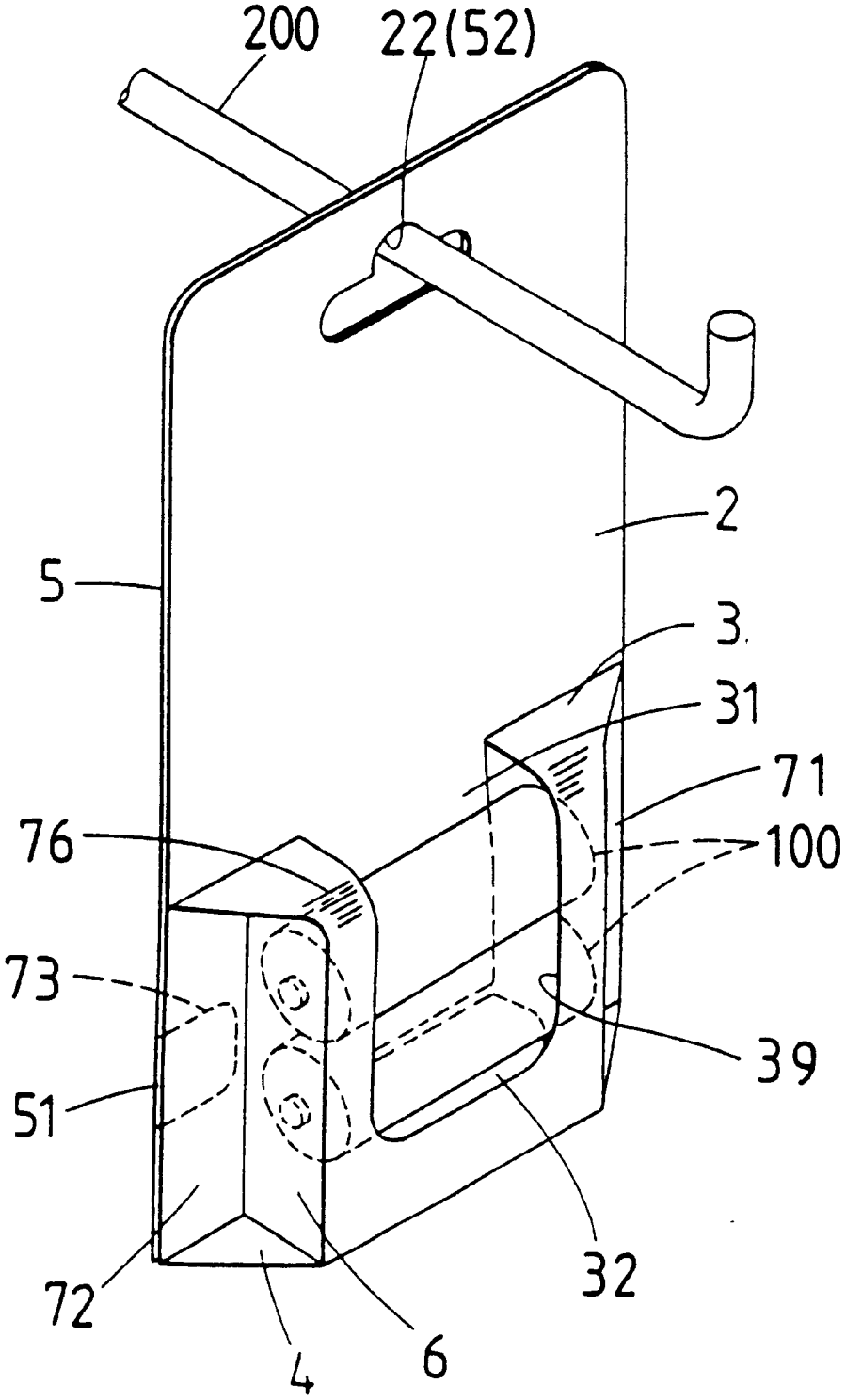
FIG. 3 is a perspective view showing an assembled packaging case according to the first embodiment of the present invention.

FIG. 1 is a development of a packaging case according to the first embodiment of the present invention. FIG. 2 is a perspective view of the packaging case in the process of assembly. FIG. 3 is a perspective view of the packaging case in an assembled state.

The packaging case 1 is designed to pack a plurality of cylindrical articles, wherein two size-AA batteries 100 are packaged as horizontally stacked up, with exposing a part of their cylindrical surface. As shown in FIG. 3, the packaging case 1 allows visual access to the content, when hanged on a display hook 200.

As shown in the development of FIG. 1, the packaging case 1 has a one-piece structure comprising a front hanging board 2 having a hook hole 22 in the upper end thereof, a front cover 3, a bottom cover 4, and a back hanging board 5 having a hook hole 52 in the lower end thereof in axial symmetry with the hook hole 22, wherein each section continuously follows the lower edge of the preceding section in this order, bordered by fold lines 91, 92, 93, respectively. In addition, side covers 61, 62 and glue margins 71, 72 extend continuously from the side edges of the front cover 3 except the top portion thereof, bordered by fold lines 94, 95, respectively.

As shown in FIG. 3, a window 39 is formed in the front cover 3. The front cover 3 has an H-shaped cut defined by a pair of cut lines 81, 81 vertically extending from the fold line 91 bordering on the front hanging board 2 to the neighbourhood of the fold line 92 bordering on the bottom cover 4, and a cut line 82 horizontally connecting the cut lines 81. The H-shaped cut provides an upper flap 31 and a lower flap 32, each of which is inwardly folded to create the window 39. The upper flap 31 is then glued to the back hanging board 5. The interval between the cut lines 81, 81 is less than the length of the size-AA battery 100, and the bottom ends of the cut lines 81, 81 are connected by a fold line 96.

In the back hanging board 5, a U-shaped tear portion 51 is defined by perforations 73 on one side edge which is to be glued to the left glue margin 72.

A plurality of grooves 76 are formed on the top portion of the front cover 3 at a predetermined interval, avoiding the upper flap 31. These grooves allow the front cover 3 to bend along the cylindrical surface of the battery 100, as described below.

The packaging case 1 is manufactured by cutting a mount (mount board) according to the development in FIG. 1, making the fold lines, perforations, cuts and the like in the cut-out pattern, and then gluing the predetermined areas.

Referring to FIG. 2, the assembly process of the packaging case 1 is hereinafter disclosed.

First, the front cover 3 is folded upward, except the upper flap 31, along the fold line 91 to the front hanging board 2. The bottom cover 4 is folded backward along the fold line 92 to the front cover 3, and the back hanging board 5 is folded backward along the fold line 93 to the bottom cover 4. The side covers 61, 62 are folded backward along the fold lines 94 to the front cover 3, while the glue margins 71, 72 are folded forward along the fold lines 95 to the side covers 61, 62.

Next, the front hanging board 2 and the back hanging board 5 are glued back to back, with matching up the hook holes 22, 52. While the upper flap 31 is likewise glued to the back hanging board 5, the lower flap 32 is folded inwards along the fold line 96. Then, the back of the left glue margin 72 is glued to the back of the U-shaped tear portion 51 defined by the perforations 73 in the back hanging board 5, whereby one side of the packaging case is closed. In this process, the grooves 76 allow the top portion of the front cover 3 to bend along the cylindrical surface of the battery 100. As a result, there is provided a compartment enclosed by the back hanging board 5 with the glued upper flap 31, the front cover 3 with the window 39, the lower flap 32 and the left side cover 62, while leaving the other side open. The free side of the compartment is closed, after two size-AA batteries 100 are inserted, by gluing the right glue margin 71 back to back with the back hanging board 5.

The two size-AA batteries 100, enclosed in the packaging case 1 as described above, have the cylindrical surface (jacket) thereof supported by the front cover 3 except the window 39, the lower flap 32 and the back hanging board 5, and have the end surfaces (covers) supported by the side covers 61, 62. On the other hand, the cylindrical surfaces of the two batteries 100 are partially exposed from the window 39 formed in the front cover 3. Therefore, when the packaging case 1 containing two size-AA batteries 100 is hanged on the display hook 200, the contents (batteries 100) are firmly held in the package and still visually accessible through the window 39.

In case the packaging case 1 falls down on the ground from the hook 200, it can satisfactorily bear the impact of the fall, owing to the dual structure in which the periphery of the back hanging board 5 is glued to the front hanging board 2 and the glue margins 71, 72, and also to the cushion effect of the lower flap 32 with respect to the batteries 100. In addition, the front cover 3, which holds the batteries 100 by both end portions of the cylindrical surface, has a U-shaped structure defined by the window 39 and a bridge provided between the fold lines 96, 92. This structure ensures the rigidity of the window frame (window edges), even when the fall impact of the batteries 100 may act on the window frame along the cut lines 81 in the front cover 3. Thus, the front cover 3 firmly supports the batteries 100 and prevents them from bouncing out of the packaging case 1.

In the meantime, a consumer can open the packaging case 1 in the following manner. First, the tear portion 51 glued to the glue margin 72 is torn away from the back hanging board 5 along the perforations 73. Then, the glue margin 72 is pulled with the side cover 62 to open one side of the packaging case which has supported the corresponding end surfaces (covers) of the batteries 100. The two size-AA batteries 100 are taken out through this opening.

Incidentally, the packaging case 1 is made solely of a mount (board, cardboard) Therefore, the empty packages are disposed without any trouble of separating various kinds of materials, and may be utilised as recycled paper. Since no plastics or like materials are included, the packaging case 1 can be burnt without any damage or harm to incinerators and environments.

It should be noted that the structure of the window 39 is not limited to the one described above. In the above embodiment, the window 39 is formed without leaving any scraps, by folding the upper flap 31 and the lower flap 32 provided along an H-shaped cut in the front cover 3, with the upper flap 31 reinforcing the back hanging board 5. Instead, the window may be formed by folding a U-shaped flap which is created along a U-shaped cut in the front cover 3. In this case, the batteries 100 are directly held on the bottom cover 4. Additionally, where the reinforcement of the back hanging board 5 is not essential, the window may be formed by punching, which leaves a square punched piece.

Figure 4:
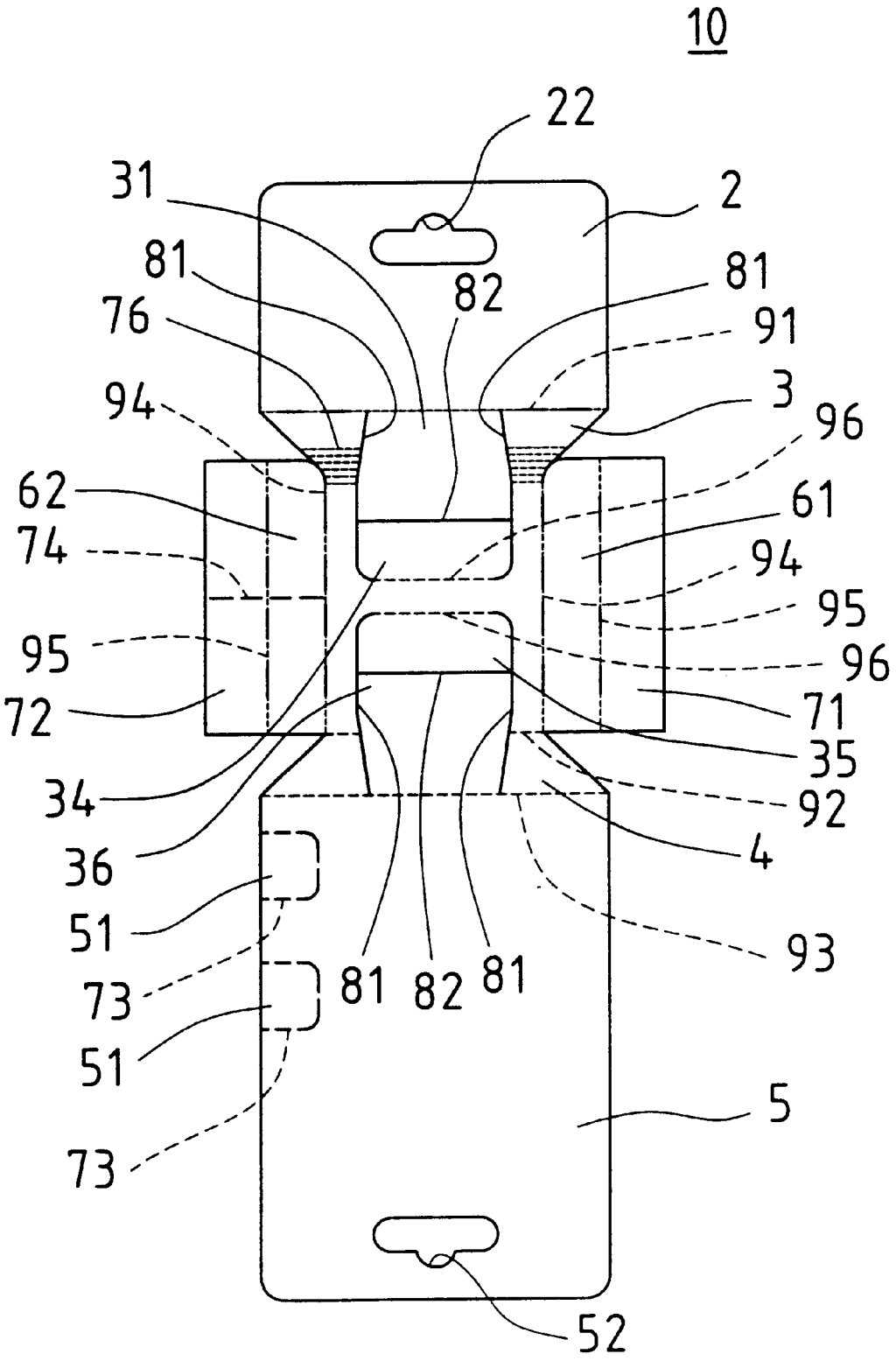
FIG. 4 is a development of a packaging case according to the second embodiment of the present invention.
Figure 5:
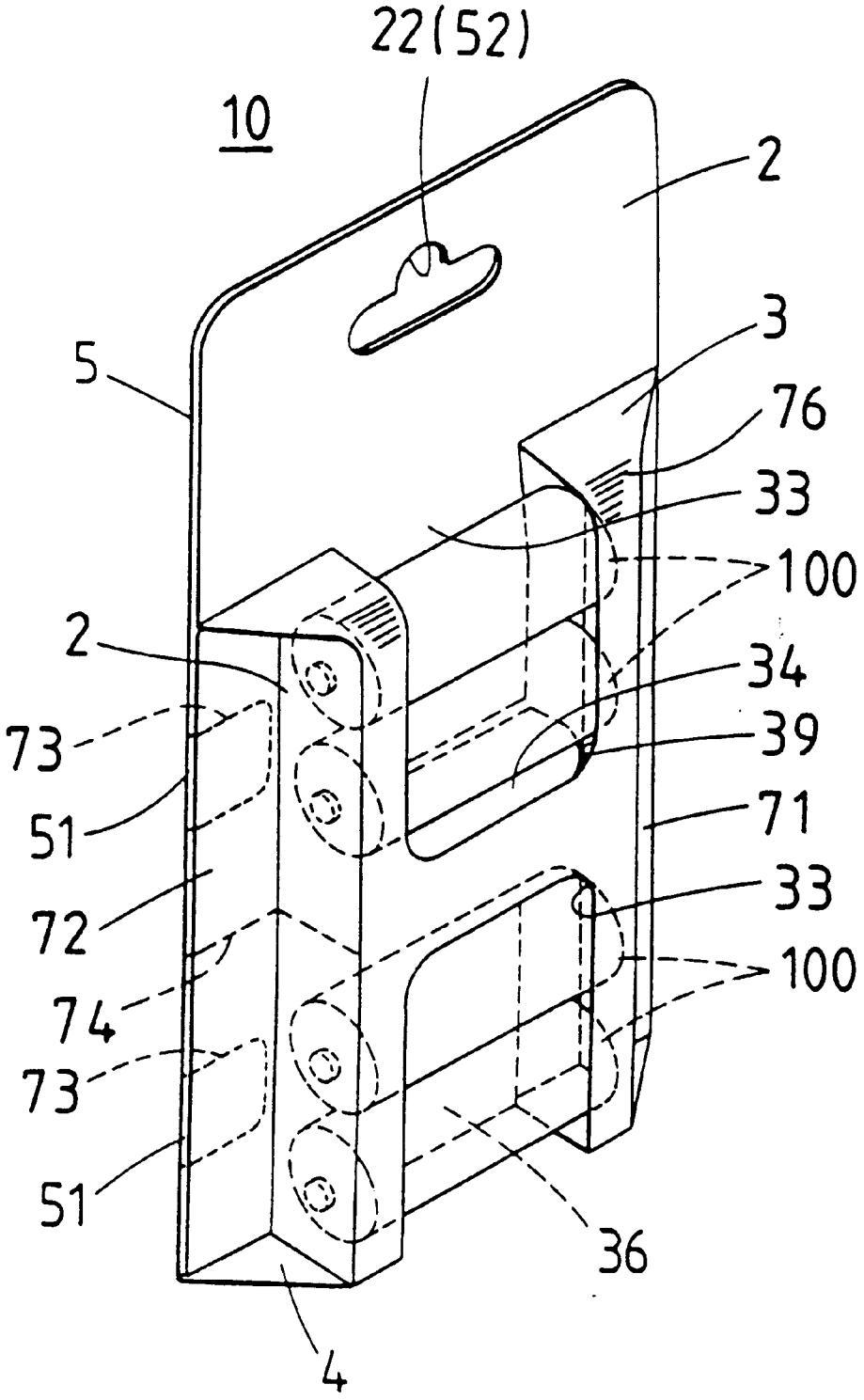
FIG. 5 is a perspective view showing an assembled packaging case according to the second embodiment of the present invention.

While the packaging case 1 in the above embodiment is directed to packaging of two size-AA batteries 100, the present invention further provides a packaging case for more than two size-AA batteries 100. Referring to FIGS. 4 and 5, description is made of the second embodiment directed to a packaging case 10 for four size-AA batteries 100. FIG. 4 is a development of a packaging case according to the second embodiment of the present invention. FIG. 5 is a perspective view of the packaging case in an assembled state. The same elements as used in FIGS. 1 to 3 of the first embodiment are identified with the same reference figures.

Similar to the packaging case 1, the packaging case 10 has, as shown in the development of FIG. 4, a one-piece structure comprising a front hanging board 2 having a hook hole 22 in the upper end thereof, a front cover 3, a bottom cover 4, and a back hanging board 5 having a hook hole 52 in the lower end thereof in axial symmetry with the hook hole 22, wherein each section continuously follows the lower edge of the preceding section in this order, bordered by fold lines 91, 92, 93, respectively. In addition, side covers 61, 62 and glue margins 71, 72 extend continuously from the side edges of the front cover 3 except the top portion thereof, bordered by fold lines 94, 95, respectively.

In this embodiment, as shown in FIG. 5, two vertically spaced windows 39 are formed in the surface including the front cover 3 and the bottom cover 4. For a top window 39, an H-shaped cut is made along a pair of cut lines 81, 81 vertically extending from the fold line 91 bordering on the front hanging board 2 to the near-centre in the front cover 3, and a cut line 82 horizontally connecting the cut lines 81, 81. The H-shaped cut provides an upper flap 33 and a lower flap 34, which are inwardly folded to create the top window 39. For a bottom window 39, an H-shaped cut is made along a pair of cut lines 81, 81 vertically extending from the near-centre in the front cover 3 through the bottom cover 4 to the fold line 93 bordering on the back hanging board 5, and a cut line 82 horizontally connecting the cut lines 81, 81. The H-shaped cut provides an upper flap 35 and a lower flap 36, which are inwardly folded to create the bottom window 39.

The interval between the cut lines 81, 81 is less than the length of the size-AA battery 100. Now, there are provided two fold lines 96 connecting the cut lines 81: one running between the bottom ends of the cut lines 81, 81 in the top H-shaped cut, and the other running between the top ends thereof in the bottom H-shaped cut. The two H-shaped cuts for the top and bottom windows 39 are axially symmetrical with each other.

The left side cover 62 and the left glue margin 72 are horizontally divided by a perforation line 74 which correlates to the bridge between the two windows 39. In the back hanging board 5, two U-shaped tear portions 51, spaced lengthwise from each other, are defined by perforations 73 on one side edge which is to be glued to the perforated left glue margin 72 in the assembled packaging case 10.

A plurality of grooves 76 are formed on the top portion of the front cover 3 at a predetermined interval, avoiding the upper flap 33. These grooves allow the front cover 3 to bend along the cylindrical surface of the battery 100, as described below.

The packaging case 10 is manufactured by cutting a mount (mount board) according to the development in FIG. 4, making the fold lines, perforations, cuts and the like in the cut-out pattern, and then gluing the predetermined areas.

The packaging case 10 is assembled in the following manner. First, the front cover 3 is folded upward, except the upper flap 33, along the fold line 91 to the front hanging board 2. Then, avoiding the lower flap 36, the bottom cover 4 is folded backward along the fold line 92 to the front cover 3, and the back hanging board 5 is folded backward along the fold line 93 to the bottom cover 4. The side covers 61, 62 are folded inward along the fold lines 94 to the front cover 3, while the glue margins 71, 72 are folded forward along the fold lines 95 to the side covers 61, 62.

Next, the front hanging board 2 and the back hanging board 5 are glued back to back, with matching up the hook holes 22, 52. While the upper flap 33 and the lower flap 36 are glued back to back with the back hanging board 5, the lower flap 34 and the upper flap 35 are folded inwards along the fold lines 96. Then, the back of the left glue margin 72 is glued to the back of the U-shaped tear portions 51 defined by the perforations 73 in the back hanging board 5, whereby one side of the packaging case is closed. In this process, the grooves 76 allow the top portion of the front cover 3 to bend along the cylindrical surface of the battery 100. As a result, there are provided two compartments: the upper compartment enclosed by the back hanging board 5 with the glued upper flap 33, the front cover 3 with the top window 39, the lower flap 34 and the left side cover 62; and the lower compartment enclosed by the back hanging board 5 with the glued lower flap 36, the front cover 3 and bottom cover 4 with the bottom window 39, the upper flap 35 and the left side cover 62, while leaving the other side of both compartments open. The free side shared by these compartments is closed, after two size-AA batteries 100 are inserted into each compartment, by gluing the right glue margin 71 back to back with the back hanging board 5.

The four size-AA batteries 100, enclosed in pairs in the packaging case 10, have the cylindrical surface (jacket) thereof supported by the front cover 3 and bottom cover 4 except the windows 39, and the back hanging board 5, and have the end surfaces (covers) supported by the side covers 61, 62. On the other hand, the cylindrical surfaces of the four batteries 100 are partially exposed from the top and bottom windows 39, 39 formed in the surface including the front cover 3 and the bottom cover 4. Therefore, when the packaging case 10 containing four size-AA batteries 100, two batteries each in two compartments, is hanged on the display hook 200, the contents (batteries 100) are firmly held in the package and still visually accessible through the windows 39.

In case the packaging case 10 falls down on the ground from the hook 200, it can satisfactorily bear the impact of the fall, owing to the dual structure in which the periphery of the back hanging board 5 is glued to the front hanging board 2 and the glue margins 71, 72, and also to the cushion effect of the lower flap 34 and the upper flap 35 with respect to the batteries 100. In addition, the surface including the front cover 3 and the bottom cover 4, which holds the batteries 100 by both end portions of the cylindrical surface, has an H-shaped structure defined by the top and bottom windows 39 and a bridge provided between the fold lines 96, 96. This structure ensures the rigidity of the window frame (window edges), even when the fall impact of the batteries 100 may act on the window frames along the cut lines 81 in the front cover 3 and bottom cover 4. Thus, the front cover 3 and bottom cover 4 together firmly support the batteries 100 and prevent them from bouncing out of the packaging case 10.

In the meantime, a consumer can open the packaging case 10 in the following manner. First, one of the two tear portions 51 glued to the glue margin 72 is torn away from the back hanging board 5 along the perforations 73. Then, the glue margin 72 and the torn tear portion 51 are pulled along the perforation line 74 which horizontally runs through the side cover 62 and the glue margin 72. Thereby, one side of the packaging case is half-opened to expose the end surfaces of the corresponding pair of batteries 100, from where the two batteries 100 can be taken out.

Likewise, four batteries 100 can be taken out at a time. Firstly, two tear portions 51 are torn away from the back hanging board 5 along the respective perforations 73. Then, the glue margin 72 is pulled with the side cover 62 to open one side of the packaging case which has supported the corresponding end surfaces of the batteries 100, from where the four batteries 100 can be taken out.

Incidentally, the packaging case 10 is made solely of a mount (board, cardboard). Therefore, the empty packages are disposed without any trouble of separating various kinds of materials, and may be utilised as recycled paper.

The packaging case 10 in this embodiment is designed to accommodate four size-AA batteries 100, two batteries each in two compartments. Further, this embodiment may be arranged to accommodate six size-AA batteries, three batteries each in two compartments.

The packaging cases 1, 10 according to the above embodiments are both designed for size-AA batteries. A further modification may be made to accommodate a plurality of size-AAA batteries.

Figure 6:
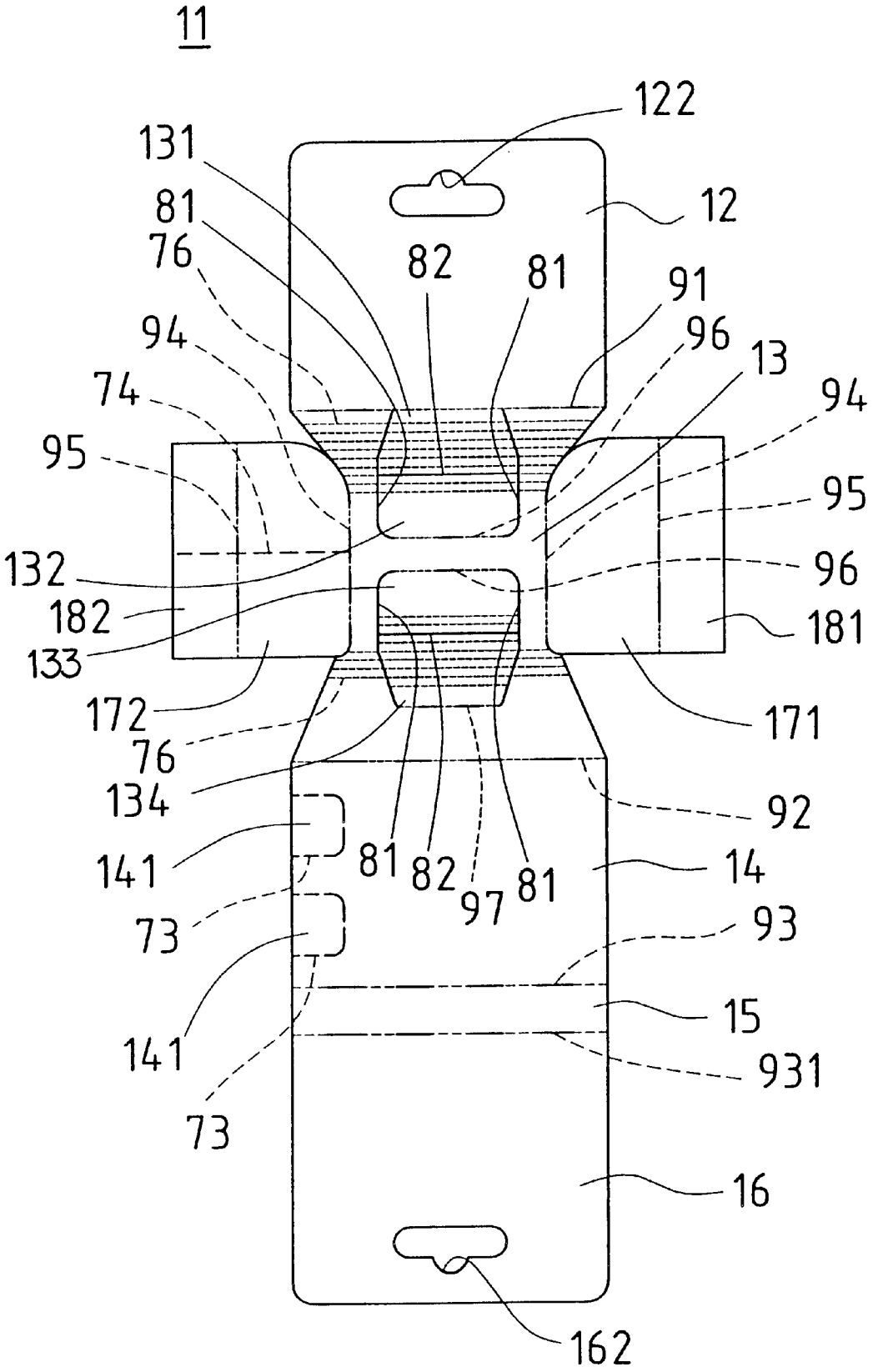
FIG. 6 is a development of a packaging case according to the third embodiment of the present invention.
Figure 7:
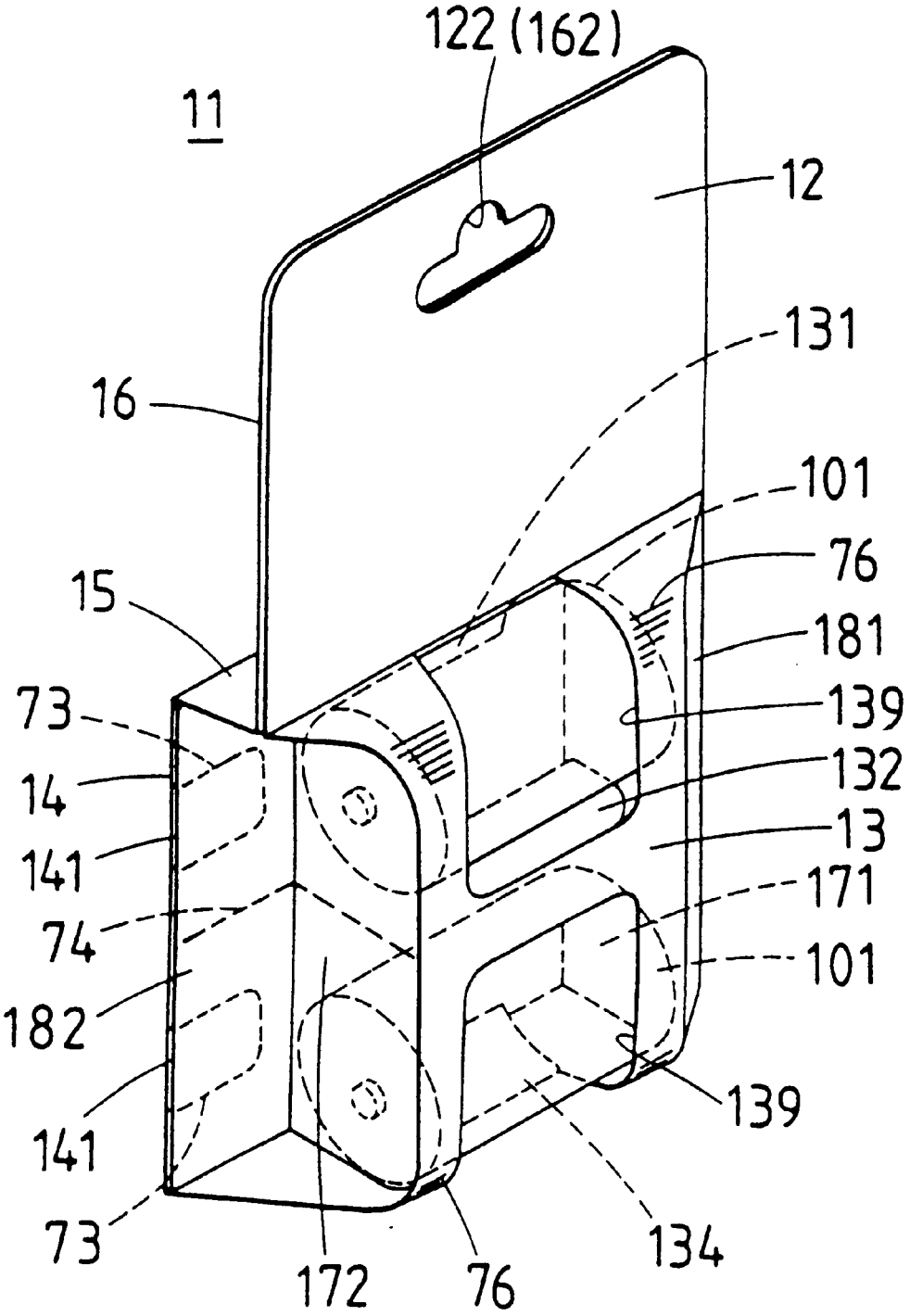
FIG. 7 is a perspective view showing an assembled packaging case according to the third embodiment of the present invention.

Now, referring to FIGS. 6 and 7, the third embodiment is directed to a packaging case 11 for size-C batteries. FIG. 6 is a development of a packaging case according to the third embodiment of the present invention. FIG. 7 is a perspective view of the packaging case in an assembled state.

As shown in the development of FIG. 6, the packaging case 11 has a one-piece structure comprising a front hanging board 12 having a hook hole 122 in the upper end thereof, a front/bottom cover 13, a back cover 14, a top cover 15, and a back hanging board 16 having a hook hole 162 in the lower end thereof in axial symmetry with the hook hole 122, wherein each section continuously follows the lower edge of the preceding section in this order, bordered by fold lines 91, 92, 93, 931, respectively. In addition, side covers 171, 172 and glue margins 181, 182 extend continuously from the side edges of the front/bottom cover 13 except the top and bottom portions thereof, bordered by fold lines 94, 95, respectively.

As shown in FIG. 7, two vertically spaced windows 139 are formed in the front/bottom cover 13. For a top window 139, an H-shaped cut is made along a pair of cut lines 81, 81 vertically extending from the fold line 91 bordering on the front hanging board 12 to the near-centre in the front/bottom cover 13, and a cut line 82 horizontally connecting the cut lines 81, 81. This H-shaped cut provides an upper flap 131 and a lower flap 132, which are inwardly folded to create the top window 139. For a bottom window 139, an H-shaped cut is made along a pair of cut lines 81, 81 vertically extending from the near-centre in the front/bottom cover 13 to the neighbourhood of the fold line 92 bordering on the back cover 14, and a cut line 82 horizontally connecting the cut lines 81, 81. This H-shaped cut provides an upper flap 133 and a lower flap 134, which are inwardly folded to create the bottom window 139.

The interval between the cut lines 81, 81 is less than the length of the size-C battery 101. There are provided two fold lines 96 connecting the cut lines 81: one running between the bottom ends of the cut lines 81, 81 in the top H-shaped cut, and the other running between the top ends thereof in the bottom H-shaped cut. Additionally, the bottom ends of the cut lines 81, 81 in the bottom H-shaped cut are connected by a fold line 97. The two H-shaped cuts for the top and bottom windows 139 are axially symmetrical with each other.

The left side cover 172 and the left glue margin 182 are horizontally divided by a perforation line 74 which correlates to the bridge between the two windows 139. In the back cover 14, two U-shaped tear portions 141, spaced lengthwise from each other, are defined by perforations 73 on one side edge which is to be glued to the perforated glue margin 182 in the assembled packaging case 11.

A plurality of grooves 76 are formed on the top and bottom portions of the front/bottom cover 13 at a predetermined interval, including the flaps 131, 132 and 133, 134. The grooved sections can bend along the cylindrical surface of the battery 101, as described below.

The packaging case 11 is manufactured by cutting a mount (mount board) according to the development in FIG. 6, making the fold lines, perforations, cuts and the like in the cut-out pattern, and then gluing the predetermined areas.

The packaging case 11 is assembled in the following manner. First, the front/bottom cover 13 is folded upward, except the upper flap 131, along the fold line 91 to the front hanging board 12. Then, the back cover 14 is folded backward along the fold line 92 to the front/bottom cover 13, and the top cover 15 is folded backward along the fold line 93 to the back cover 14. The back hanging board 16 is folded outward along the fold line 931 to the top cover 15. The side covers 171, 172 are folded inward along the fold lines 94 to the front/bottom cover 13, and the glue margins 181, 182 are folded forward along the fold lines 95 to the side covers 171, 172.

Next, the front hanging board 12 and the back hanging board 16 are glued back to back, with matching up the hook holes 122, 162. The upper flap 131 and the lower flap 132 are folded inwards along the fold lines 91, 96, respectively. Likewise, the upper flap 133 and the lower flap 134 are folded inwards along the fold lines 96, 97. Then, the back of the left glue margin 182 is glued to the back of the two U-shaped tear portions 141 defined by the perforations 73 in the back cover 14, whereby one side of the packaging case is closed. In this process, the grooves 76 allow the top and bottom portions of the front/bottom cover 13 to bend along the cylindrical surface of the batteries 101. As a result, there are provided two compartments: the upper compartment enclosed by the top cover 15, the back cover 14, the upper and lower flaps 131, 132, the front/bottom cover 13 with the top window 139, and the left side cover 172; and the lower compartment enclosed by the back cover 14, the upper and lower flaps 133, 134, the front/bottom cover 13 with the bottom window 139 and the left side cover 172, while leaving the other side of both compartments open. The free side shared by these compartments is closed, after one size-C battery 101 is inserted into each compartment, by gluing the right glue margin 181 back to back with the back cover 14.

The two size-C batteries 101, separately enclosed in the compartments, have the cylindrical surface (jacket) thereof supported by the front/bottom cover 13 except the windows 139, the back cover 14 and the top cover 15, and have the end surfaces (covers) supported by the side covers 171, 172. On the other hand, the cylindrical surfaces of the two size-C batteries 101 are partially exposed from the top and bottom windows 139, 139 formed in the front/bottom cover 13. Therefore, when the packaging case 11 containing two size-C batteries 101 in two separate compartments is hanged on the display hook 200, the contents (batteries 101) are firmly held in the package and still visually accessible through the windows 139.

In this packaging case 11, the positions of the fold lines 91, 931, which are the borders between the front hanging board 12 and the front/bottom cover 13 and between the top cover 15 and the back hanging board 16, respectively, are designed to correspond approximately to the middle of the width of the side covers 171, 172, or the centre of the diameter of the size-C battery 101. Thus, the front hanging board 12 and the back hanging board 16 are positioned, when glued together, substantially along the longitudinal axis of the size-C battery 101. As a result, when the packaging case 11 is hanged on the hook 200, the hanging position approximately agrees with the longitudinal axis of the size-C battery 101, whereby the hanging packaging case remains stable and balanced and does not lean back and forth.

In case the packaging case 11 falls down on the ground from the hook 200, it can satisfactorily bear the impact of the fall, owing to the dual structure in which the front hanging board 12 is glued to the back hanging board 16 and the periphery of the back cover 14 is glued to the glue margins 181, 182, and also to the cushion effect of the flaps 131, 132 and the flaps 133, 134 with respect to the batteries 101. In addition, the front/bottom cover 13, which holds the batteries 101 by both end portions of the cylindrical surface, possesses an H-shaped structure defined by the top and bottom windows 139 and a bridge provided between the fold lines 96, 96. This structure ensures the rigidity of the window frame (window edges), even when the fall impact of the batteries 101 may act on the window frames along the cut lines 81 in the front/bottom cover 13. Thus, the front/bottom cover 13 firmly supports the batteries 101 and prevents them from bouncing out of the packaging case 11.

In the meantime, a consumer can open the packaging case 11 in the following manner. First, one of the two tear portions 141 glued to the glue margin 182 is torn away from the back cover 14 along the perforations 73. Then, the glue margin 182 and the torn tear portion 141 are pulled along the perforation line 74 which horizontally divides the glue margin 182 and the side cover 172. Thereby, one side of the packaging case is half-opened to expose the corresponding end surface of the battery 101, from where a size-C batteries 101 can be taken out.

Likewise, two batteries 101 can be taken out at a time. Firstly, two tear portions 141 are torn away from the back cover 14 along the respective perforations 73. Then, the glue margin 182 is pulled with the side cover 172 to open one side of the packaging case which has supported the corresponding end surfaces of the batteries 101, from where the two batteries 101 can be taken out.

Incidentally, the packaging case 11 is made solely of a mount (board, cardboard). Therefore, the empty packages are disposed without any trouble of separating various kinds of materials, and may be utilised as recycled paper.

The packaging case 11 in this embodiment is designed to accommodate two size-C batteries 101, one battery each in two compartments. In addition, this embodiment may be arranged to contain two size-D batteries, one battery each in two compartments.

As described above, the packaging case shown in FIGS. 6 and 7 can hold plural batteries of sizes C and D. Considering the total weight of these batteries, however, these types of packaging cases suffer from a greater fall impact than those containing size-AA batteries or other lighter batteries. Thus, it is advantageous that the third invention further includes a structure for alleviating the fall impact and preventing the bounce-off of the batteries. By way of example, FIG. 8 shows an embodiment of a reinforced packaging case for size-C batteries, and FIG. 9 shows an embodiment of a reinforced packaging case for size-D batteries.

Figure 8:
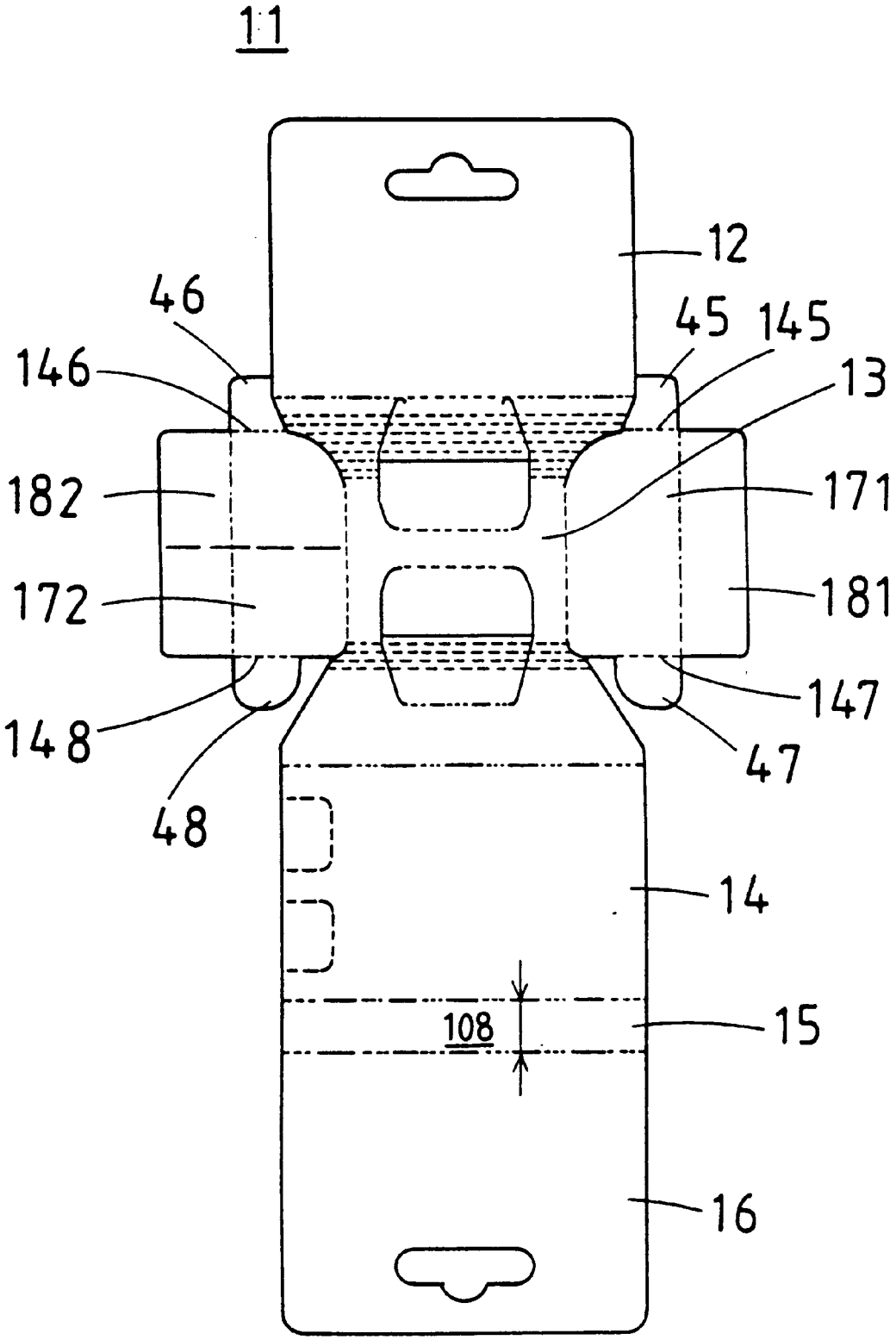
FIG. 8 is a development of another packaging case according to the third embodiment of the present invention.

The embodiment shown in FIG. 8 corresponds to that of FIG. 6, except that reinforcement flaps 45, 46, 47, 48 extend respectively from the top and bottom edges of the side covers 171, 172 via fold lines 145, 146, 147, 148.

Figure 9:
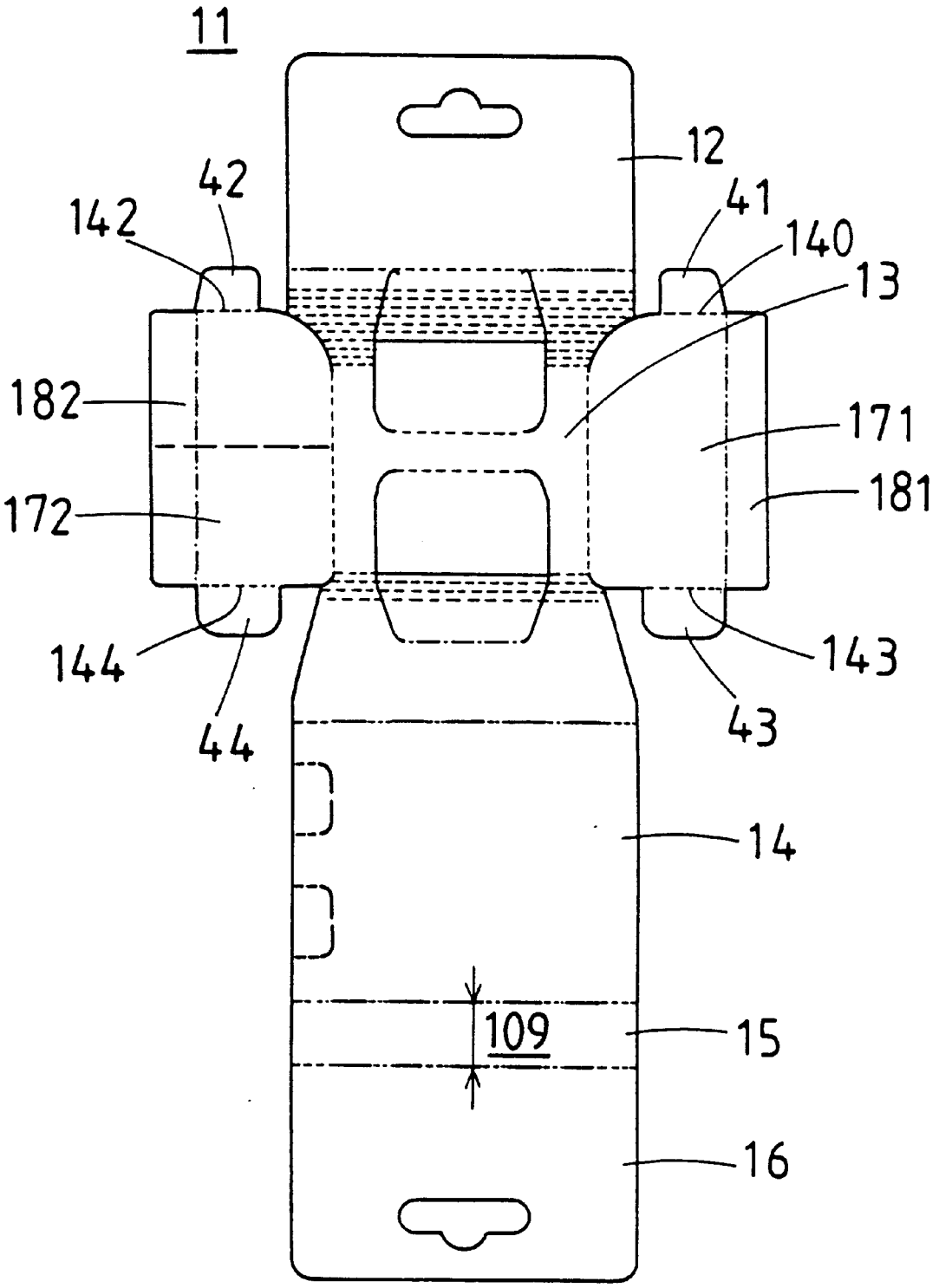
FIG. 9 is a development of yet another packaging case according to the third embodiment of the present invention.
Figure 10:
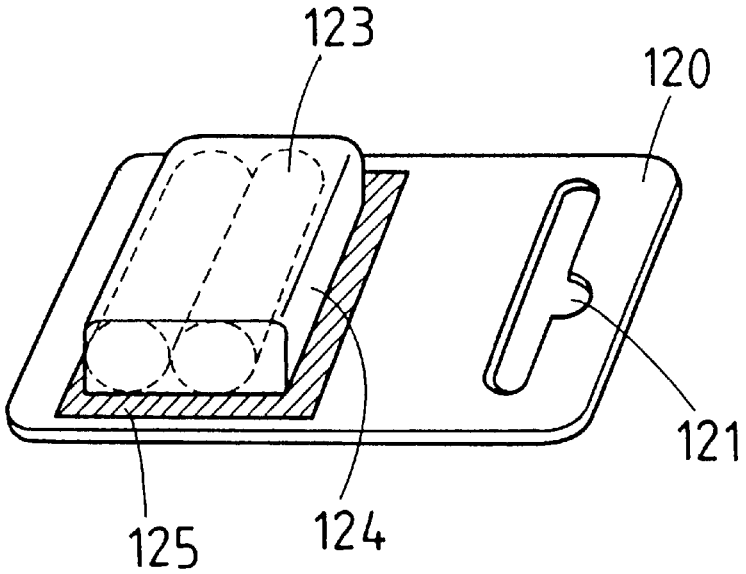
Fig.10 (PRIOR ART)
FIG. 10 is a perspective view of a conventional blister pack-type package.
Figure 11:
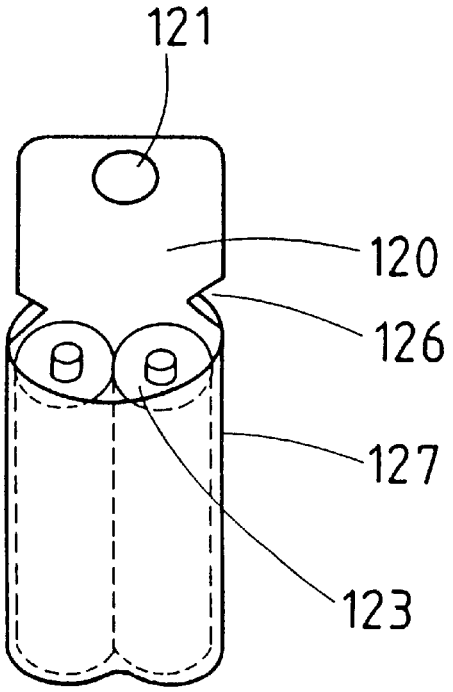
Fig.11 (PRIOR ART)
FIG. 11 is a perspective view of a conventional shrink pack-type package.

Likewise, the embodiment shown in FIG. 9 corresponds to that of FIG. 6, except that reinforcement flaps 41, 42, 43, 44 extend respectively from the top and bottom edges of the side covers 171, 172 via fold lines 140, 142, 143, 144.

In this embodiment, each of the reinforcement flaps 45, 46, 47, 48 and 41, 42, 43, 44 has a width equal to or less than the width of the top cover 15. The reinforcement flaps 45, 46, 47, 48 and 41, 42, 43, 44 are folded in substantially at a right angle, so that the end portions of the batteries are protected by L-shaped coverings. The reinforcement flaps help to pack and hold the contents more securely, serving not only as buffers against the fall impact but also as stoppers against bouncing batteries.

What is claimed is:

1. A packaging case comprising, in an assembled state: a back part comprised of a back hanging board, a top cover and a back cover; a front/bottom part comprised of a front/bottom cover and a front hanging board to be glued to the back hanging board; the boards and the covers being formed continuously in this order and bordered by fold lines; and a side part comprised of a side cover and a glue margin continuously extending from each side edge of the front/bottom cover, wherein two windows are provided in the front/bottom cover at a predetermined gap, and a hook hole is respectively punched in the front hanging board and the back hanging board such that a pair of hook holes match each other when these hanging boards are glued together, and wherein the packaging case, which is assembled by gluing the front hanging board to the back hanging board and the glue margins to the back cover, encloses a plurality of cylindrical articles in a space defined by the front/bottom cover, the back cover, the top cover and the side covers, with the end surfaces of each cylindrical article facing the side covers, and the cylindrical surface thereof being partially exposed through the windows.

2. A packaging case according to claim 1, wherein the side covers and glue margins are formed on both side edges of the front/bottom cover except the neighbourhood of the front hanging board and the back cover.

3. A packaging case according to claim 1, wherein two U-shaped perforated tear portions are provided at positions corresponding to the windows in one of the side edges of the back cover, for the purpose of tearing off a part of the side edge to which a corresponding glue margin is glued, and wherein a perforation line runs through the side cover and the glue margin on the side of the tear portions for separate opening of the windows.

4. A packaging case according to claim 1, wherein two H-shaped cuts are oppositely created in the front/bottom cover to provide four flaps, so that the two windows are formed by inwardly folding these flaps along fold lines, and wherein the folded middle flaps partition the space in the packaging case into two windowed compartments, each of which separately contains one cylindrical article.

5. A packaging case according to claim 1, wherein the front hanging board and the back hanging board are glued along the longitudinal axis of the cylindrical articles.

6. A packaging case according to claim 1, wherein a reinforcement flap, extending respectively from the top and bottom ends of the side covers and bordered by a fold line, is inwardly folded along a fold line substantially at a right angle.

7. A packaging case according to claim 2, wherein two U-shaped perforated tear portions are provided at positions corresponding to the windows in one of the side edges of the back cover, for the purpose of tearing off a part of the side edge to which a corresponding glue margin is glued, and wherein a perforation line runs through the side cover and the glue margin on the side of the tear portions for separate opening of the windows.

8. A packaging case according to claim 2, wherein two H-shaped cuts are oppositely created in the front/bottom cover to provide four flaps, so that the two windows are formed by inwardly folding these flaps along fold lines, and wherein the folded middle flaps partition the space in the packaging case into two windowed compartments, each of which separately contains one cylindrical article.

9. A packaging case according to claim 2, wherein the front hanging board and the back hanging board are glued along the longitudinal axis of the cylindrical articles.

10. A packaging case according to claim 2, wherein a reinforcement flap, extending respectively from the top and bottom ends of the side covers and bordered by a fold line, is inwardly folded along a fold line substantially at a right angle.

* * * * *